US009682381B2

(12) United States Patent
Zhou et al.

(10) Patent No.: US 9,682,381 B2
(45) Date of Patent: Jun. 20, 2017

(54) SHREDDER FEEDER

(71) Applicants: Licheng Zhou, Changzhou (CN); Jian Chen, Changzhou (CN); Jianbo Qi, Changzhou (CN); Haiting Chen, Suzhou (CN); Ziqiang Ding, Changzhou (CN)

(72) Inventors: Licheng Zhou, Changzhou (CN); Jian Chen, Changzhou (CN); Jianbo Qi, Changzhou (CN); Haiting Chen, Suzhou (CN); Ziqiang Ding, Changzhou (CN)

(73) Assignee: New United Office Equipments Co., Ltd, Changzhou (CN)

( * ) Notice: Subject to any disclaimer, the term of this patent is extended or adjusted under 35 U.S.C. 154(b) by 350 days.

(21) Appl. No.: 14/289,325

(22) Filed: May 28, 2014

(65) Prior Publication Data

US 2015/0343452 A1 Dec. 3, 2015

(51) Int. Cl.

| | |
|---|---|
| ***B02C 18/24*** | (2006.01) |
| ***B02C 18/22*** | (2006.01) |
| ***B02C 18/00*** | (2006.01) |
| ***B65H 5/00*** | (2006.01) |
| *B02C 18/16* | (2006.01) |

(52) U.S. Cl.

CPC ..... *B02C 18/2275* (2013.01); *B02C 18/0007* (2013.01); *B02C 18/24* (2013.01); *B65H 5/00* (2013.01); *B02C 2018/164* (2013.01); *B02C 2018/2208* (2013.01)

(58) Field of Classification Search

CPC . B02C 18/2275; B02C 18/24; B02C 18/0007; B02C 2018/164; B02C 2018/2208; B65H 5/00

USPC ..... 241/224, 225

See application file for complete search history.

(56) References Cited

U.S. PATENT DOCUMENTS

| | | | | |
|---|---|---|---|---|
| 4,232,860 | A | 11/1980 | Brown | |
| 4,893,759 | A | 1/1990 | Mizobata | |
| 5,975,445 | A | 11/1999 | Ko | |
| 7,500,627 | B2 * | 3/2009 | Park | B02C 18/0007 241/225 |
| 7,823,873 | B1 | 11/2010 | Su | |
| 7,926,753 | B2 | 4/2011 | Carver | |
| 8,061,635 | B2 * | 11/2011 | Kim | B02C 18/0007 241/225 |

(Continued)

*Primary Examiner* — Mark Rosenbaum

(74) *Attorney, Agent, or Firm* — Lowe Graham Jones PLLC

(57) ABSTRACT

A document shredder is disclosed including a paper receptacle for receiving a load of paper and a shredding assembly. A metering assembly is interposed between the paper receptacle and the shredding assembly and is configured to separate a portion of the load of paper from the load of paper and permit the portion of the load of paper to move into the shredding assembly. The metering assembly may include a stop plate secured thereto and defining a lifting portion on a perimeter portion thereof. The lifting portion is configured to engage a lower edge of the portion of the load of paper upon rotation of the stop plate and lift the paper over the stop plate. The lifting portion may include a flange, which may be a portion of a cone, formed on a perimeter portion of the wheel and occupying a sector of the perimeter of less than 60 degrees.

15 Claims, 7 Drawing Sheets

(56) References Cited

U.S. PATENT DOCUMENTS

2008/0210794 A1* 9/2008 Schwelling ..... B02C 18/0007
241/225

* cited by examiner

SHREDDER FEEDER

FIELD OF THE INVENTION

This invention relates generally to a document shredder. The invention relates more particularly to a paper feeding portion of the document shredder.

BACKGROUND OF THE INVENTION

Document shredders are used to shred confidential or private documents to prevent unwanted viewing of the document by another. Document shredders are available in various feed capacities. For a small volume of documents to be shredded, a document shredder which accepts a single document to be shredded at a time may be satisfactory. For a larger volume of documents to be shredded, a document shredder that may accept more than one document at a time may be preferable. Document shredders that may accept more than one document at a time may have paper feeding mechanisms that feed more than one document at a time to the shredder. However, document shredders that may accept more than one document at a time may be prone to jams in the shredder portion of the document shredder due to improper feeding of the documents to be shredded. Jams in the shredder portion of the document shredder may be caused by attempting to feed more documents at one time than the document shredder is capable of shredding, or by attempting to shred documents at a faster rate than the document shredder is capable of shredding. Therefore, a need exists in the art for a feeding mechanism for a document shredder that feeds documents to be shredded at a volume and rate that does not exceed the shredding capacity of the document shredder.

SUMMARY OF THE INVENTION

The present invention provides an apparatus for feeding a controlled amount of documents to be shredded into a document shredder at a controlled rate. The controlled, or desired amount of documents to be shredded is an amount of documents to be fed into a shredder mechanism of a document shredder that will not normally cause jamming of the shredder mechanism of the document shredder. In some embodiments, a shredder includes a paper receptacle for receiving a load of paper and a shredding assembly. A metering assembly is interposed between the paper receptacle and the shredding assembly. The metering assembly is configured to separate a portion of the load of paper from the load of paper and permit the portion of the load of paper to move into the shredding assembly. For example, the paper receptacle may be at a higher elevation than the shredding assembly.

In another aspect of the invention, the paper receptacle defines a ridge that engages a lower edge portion of the load of paper. The metering assembly may be configured to urge the portion of the load of paper over the ridge. The paper receptacle may include a base positioned to support lower edges of sheets of the load of paper. A support may extend upwardly from a rear portion of the base and the lip may be secured to a forward portion of the base. The paper receptacle may further include a biasing member positioned to urge the load of paper toward the metering assembly.

In another aspect of the invention, the metering assembly includes a metering shaft having an axis of rotation oriented perpendicular to lower edges of sheets in the load of paper. A stop plate is secured to the metering shaft and defines a lifting portion on a perimeter portion thereof. The lifting portion is configured to engage a lower edge of the portion of the load of paper. In some embodiments, the stop plate is embodied as a wheel and the lifting portion includes flange secured to a perimeter portion of the wheel. The flange may be embodied as a portion of a cone concentric with an axis of rotation of the wheel. In some embodiments, the lifting portion lies entirely in a sector of the stop plate smaller than 60 degrees with respect to an axis of rotation of the metering shaft.

In another aspect of the invention, a shaft support engages the metering shaft having the stop plate positioned between the shaft support and the paper receptacle. The shaft support may further include a ramp secured thereto and defining a ramp surface sloping downwardly from the metering shaft.

In some embodiments, the shredding assembly includes two cutting blade assemblies and a motor coupled to the cutting shafts. The motor, or a different motor, is also coupled to the metering shaft. The cutting blade assemblies may shred paper of length L with a linear feed rate F and be able, or rated, to simultaneously shred a maximum number of sheets M. The metering assembly may be configured to separate portions of paper of at most N sheets from the load of paper with a period T. The values of T and N may be configured such that N*ceiling(L/(F*T)) is less than M.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
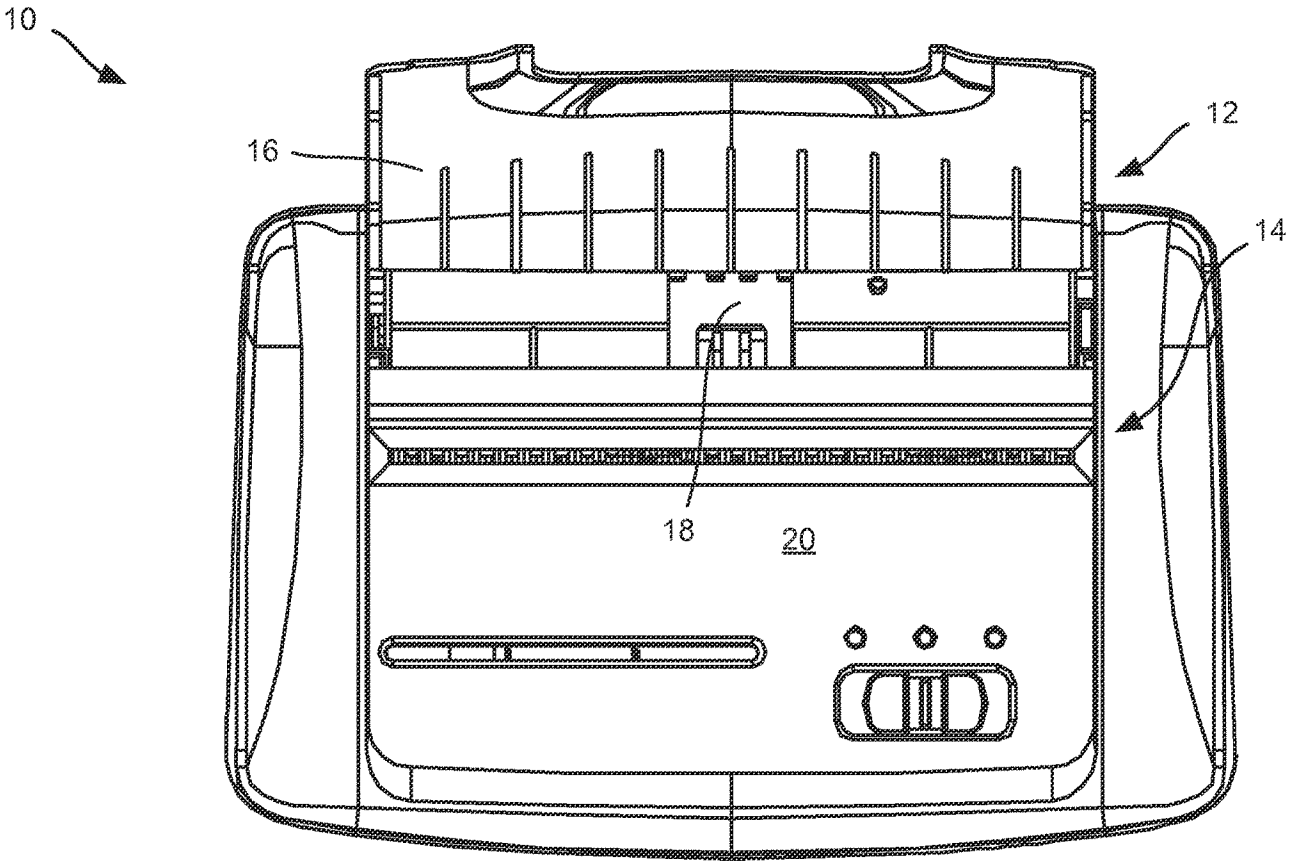
FIG. 1 illustrates a top plan view of a document shredder in accordance with an embodiment of the present invention.

FIG. 1 illustrates an embodiment of a document shredder 10. The document shredder 10 includes a feeder portion 12 and a shredding portion 14. The feeder portion 12 includes a paper tray 16 and a biasing plate 18. The feeder portion 12 and shredding portion 14 may be secured to and/or housed within a housing 20.

Figure 2:
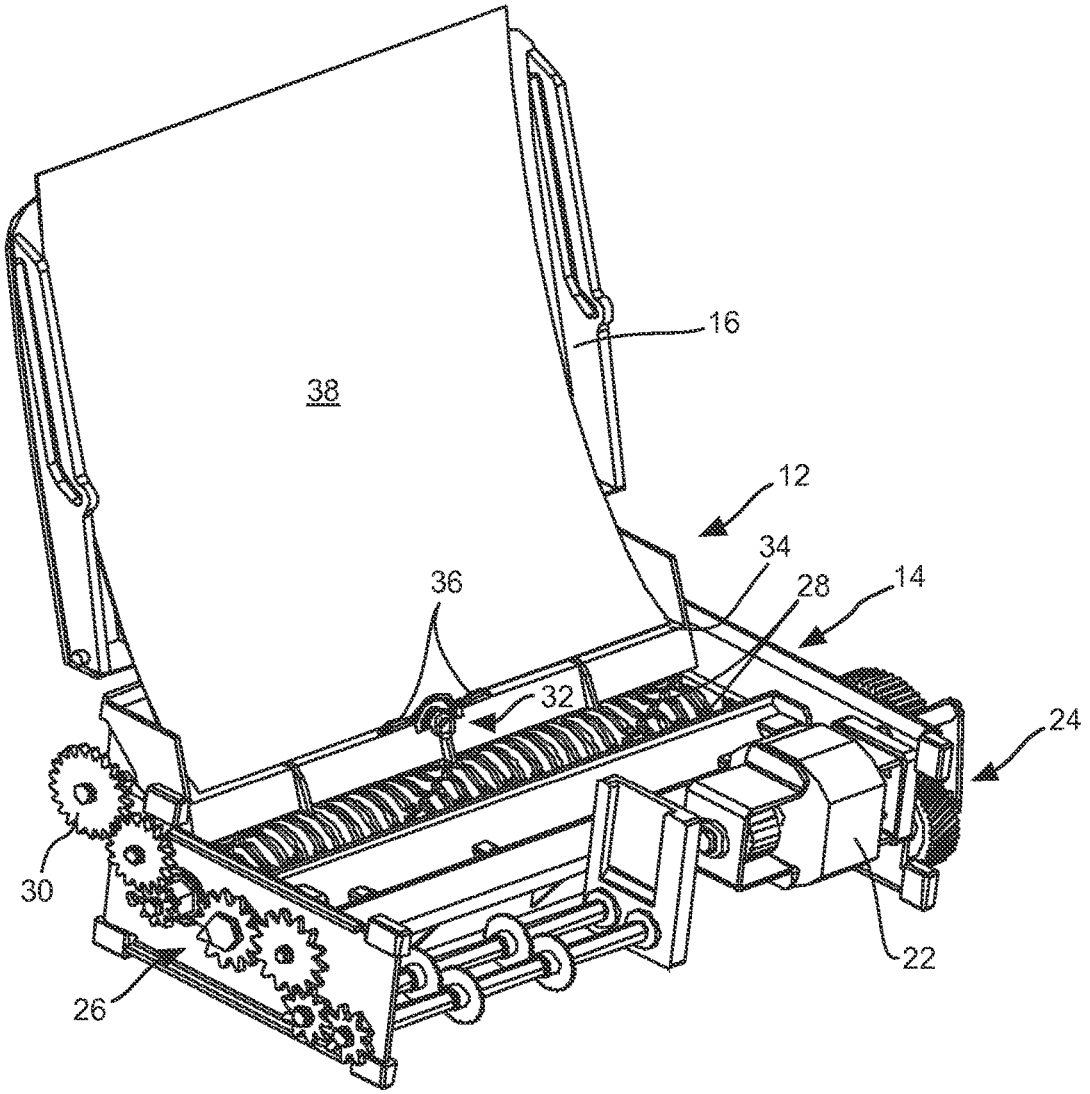
FIG. 2 illustrates an isometric view of a drive mechanism for the document shredder including a metering assembly in accordance with an embodiment of the present invention.

Referring to FIG. 2, the shredding assembly 14 may include a motor 22 for driving the shredding assembly 14. The motor 22 may output power to a gear assembly 24 and a gear assembly 26. As is apparent in FIG. 2, the gear assemblies 24, 26 are located on opposite sides of the cutting blade assemblies 28. The cutting blade assemblies 28 may each include shafts having a number of blades secured thereto and interleaved with the blades of the opposing cutting blade assembly 28. The cutting blades may be configured according to any embodiment known in the art.

In some embodiments, gear assembly 26 is driven by the motor 22 by means of the cutting blade assemblies 28. The manner in which the motor 22 drives the cutting blade assemblies 28 and the configuration of the gear assemblies 24, 26 may be according to any embodiment known in the art.

In some embodiments, the motor 22 may drive a gear 30 that actuates a metering assembly 32 for dispensing paper within the paper tray 16. Alternatively, the metering assembly 32 may be actuated by a different motor. In the illustrated embodiment, the gear 30 is driven by gear assembly 26. However, in other embodiments, the gear 30 may engage the gear assembly 24 or be coupled to the motor 22 by some other gear assembly or other actuation means.

As will be described in greater detail below, the metering assembly 32 dispenses paper 38 from the tray 16 in a controlled manner such that a user is relieved of the task of feeding paper into the shredding portion 14 and jamming of the shredding portion 14 is reduced or eliminated. In the illustrated embodiment, the paper tray 16 secures to a base 34. The paper tray 16 may maintain the paper 38 in a substantially vertical orientation. For example, the tray 16 may be oriented, or selectively placed into an orientation, at an angle of less than 45 degrees, preferably less than 30 degrees, more preferably less than 15 degrees, with respect to vertical when the shredder 10 is resting on a flat surface. The base 34 may be substantially horizontal when the shredder 10 is resting on a flat surface, e.g. within +/−15 degrees of horizontal.

The paper 38 may be prevented from sliding off the base 34 in response to gravity and/or the action of the biasing plate (see FIG. 1) by means of the metering assembly 32. For example, the metering assembly 32 itself may be positioned at one side of the base 34 having the paper tray 16 extending from an opposing side such that a lower portion of the paper 38 is positioned between the metering assembly 32 and the paper tray 16. In some embodiments, one or more ridges 36 are secured to the base 34, such a portion of the base 34 extends between the one or more ridges 36 and the paper tray 16. In this manner, the paper 38 is prevented from falling into the shredding portion 14 due to gravity and the action of the biasing plate 18. In some embodiments, the metering assembly 32 may be operable to lift sheets of the paper 38 over the one or more ridges 36.

Figure 3A:
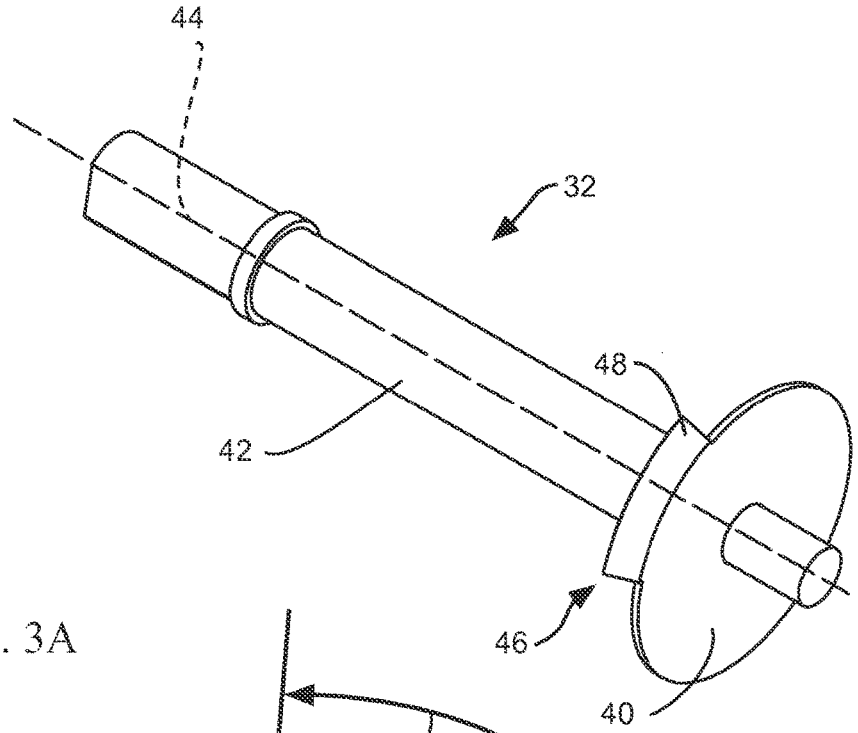
FIGS. 3A through 3C illustrate a metering assembly in accordance with an embodiment of the present invention.
Figure 3B:
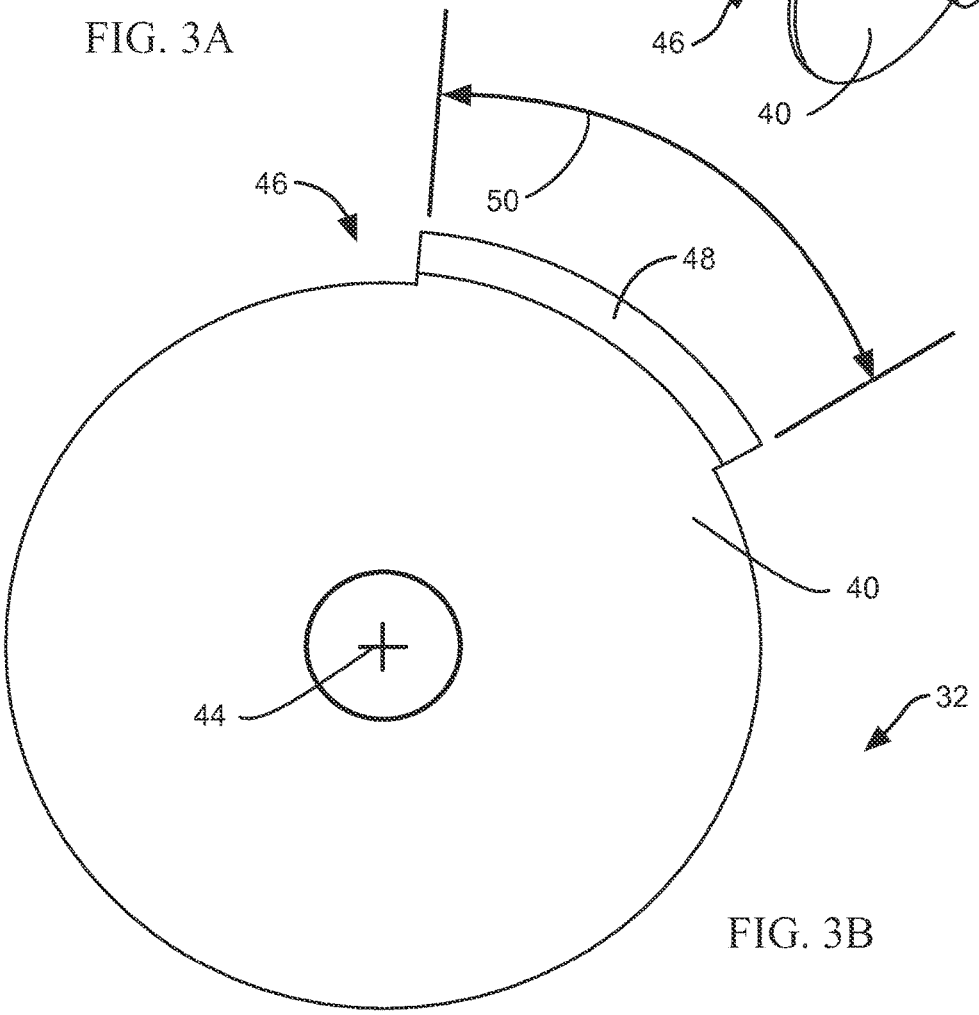

Referring to FIGS. 3A and 3B, the metering assembly 32 may include a stop plate 40 coupled to a shaft 42. The stop plate 40 may be substantially planar in a plane perpendicular to the axis of rotation 44 of the shaft 42. In the illustrated embodiment, the stop plate 40 has a round perimeter. However, other perimeter shapes may also be used. The stop plate 40 may define a lifting portion 46 operable to lift portions of a load of paper and allow the portions to fall into the shredder in response to rotation of the shaft 44. The lifting portion 46 may lie in a sector of the stop plate 40, with respect to the axis of rotation 44, that is less than 60 degrees, e.g. between 45 and 60 degrees. In this manner, for a major portion of the period of rotation of the stop plate 40, no paper is being lifted, thereby allowing a previous batch of paper to completely or partially pass through the shredding portion 14. In some embodiments, multiple lifting portions 46 are distributed uniformly around the perimeter of the stop plate 40.

In the illustrated embodiment, the lifting portion 46 is embodied as a flange 48 extending from a perimeter of the stop plate 40. The flange 48 may be sector shaped in a plane perpendicular to the axis of rotation 44 (the plane of the page for FIG. 3B), the sector being centered on the axis or rotation 44. As is apparent in FIG. 3B, there is an abrupt radial step between the flange 48 and the perimeter of the wheel 44. In other embodiments, a smoother transition between the larger radius of the flange 48 and the radius of the wheel 44 may be used. The angular width 50 occupied by the flange 48 is less than 180 degrees, preferably less than 90 degrees, and, more preferably, less than 60 degrees. For example, the angular width 50 may be between 45 and 60 degrees. In the illustrated embodiment, the angular width 50 is approximately 55 degrees.

Figure 3C:
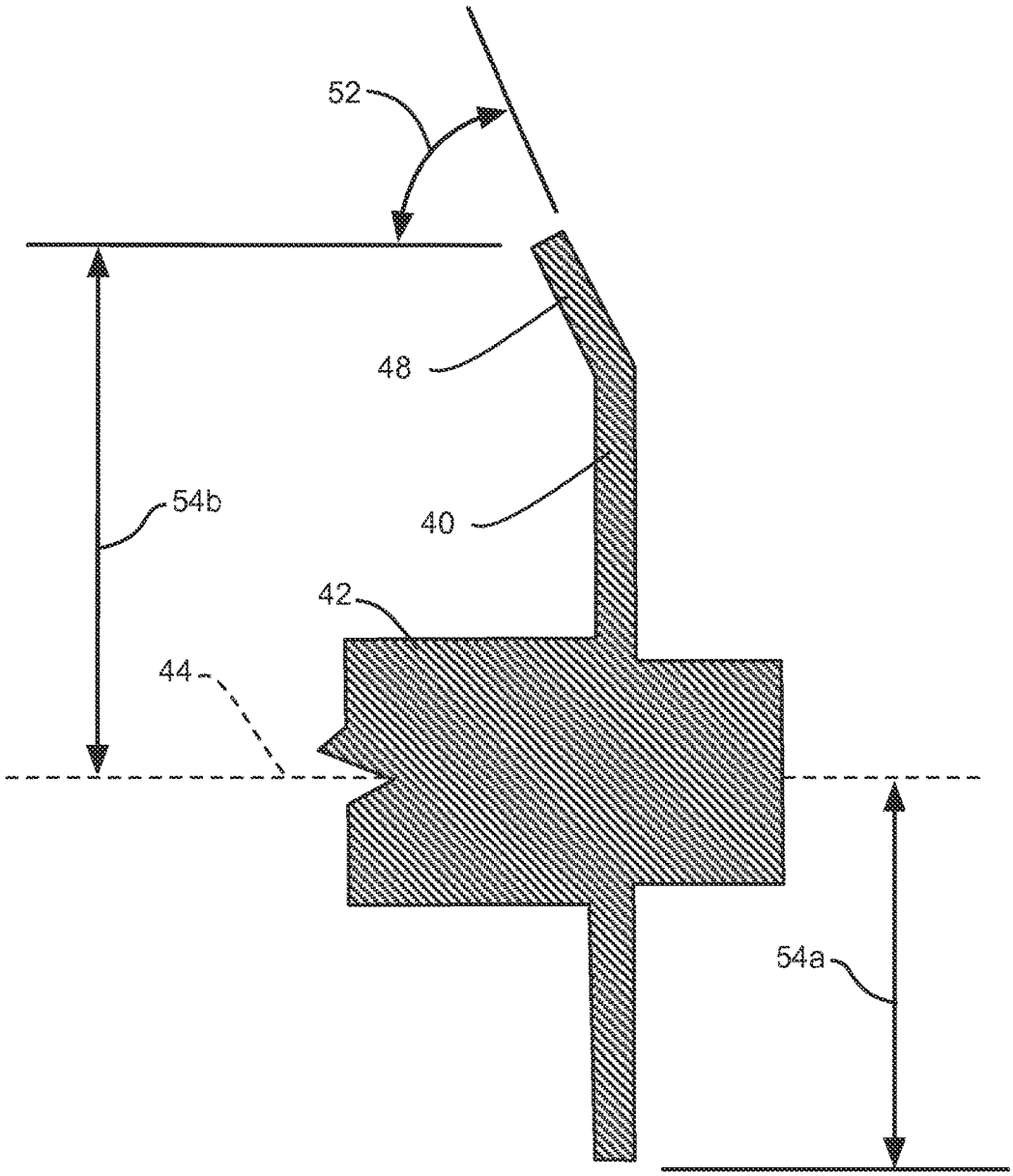
Figure 4:
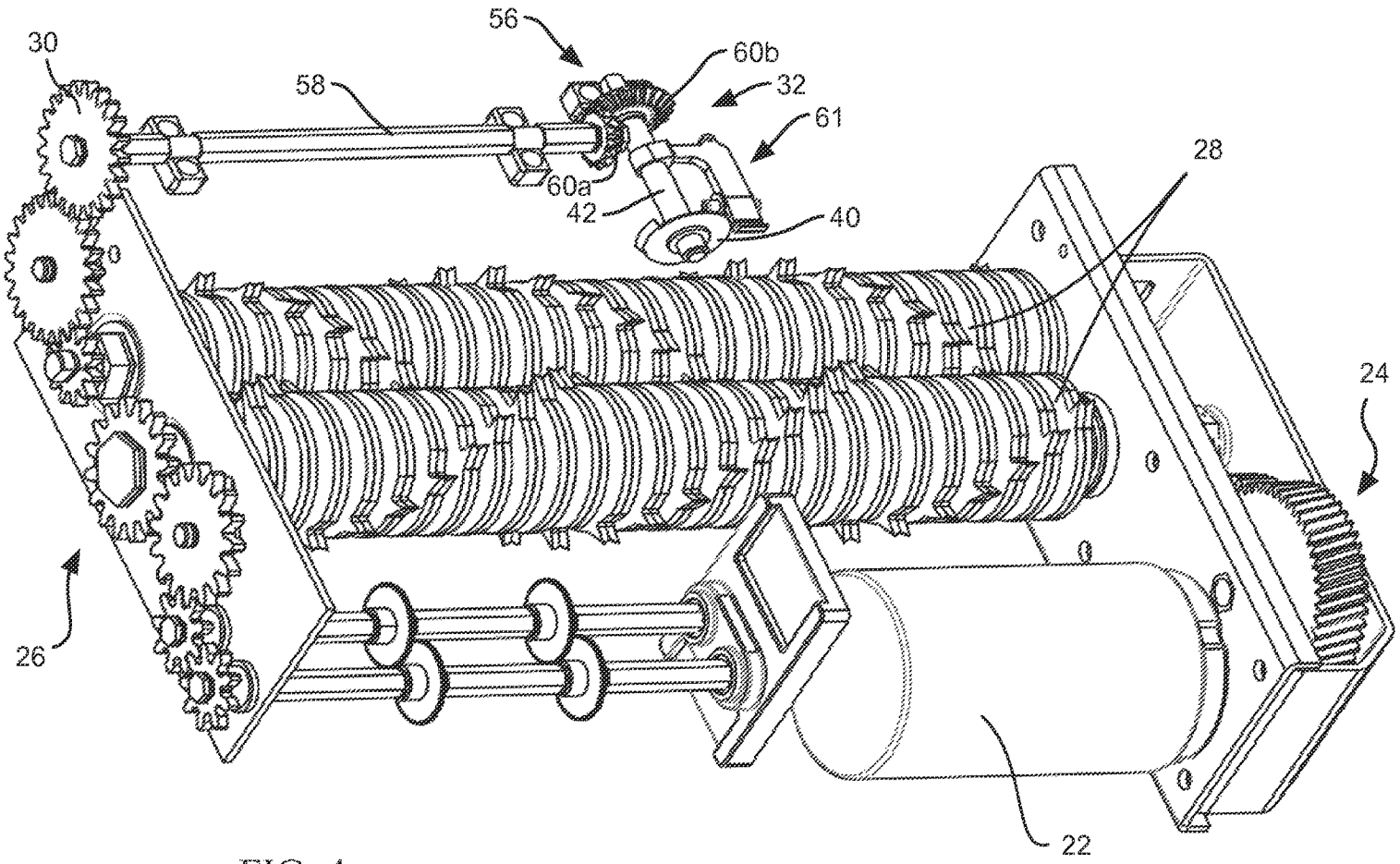
FIG. 4 is an isometric view of a drive mechanism for a metering assembly in accordance with an embodiment of the present invention.

Referring specifically to FIG. 3C, as noted above, the flange 48 may be embodied a portion of a conical surface, such as a portion of a cone secured to the perimeter of the stop plate 40, the cone defined by an outer surface at an angle 52 relative to the axis of rotation 44 and symmetrical about the axis of rotation 44. In some embodiments, the inner surface of the flange 48 may be oriented at the same angle relative to the axis of rotation 44 as the outer surface. In other embodiments, the inner surface defines a greater angle such that the flange 48 tapers with distance from the axis of rotation 44.

In some embodiments, the angle 52 may be substantially equal to an angle defined by paper stacked in a shredder with respect to the axis of rotation 44. For example, the angle 52 may be such that when the metering assembly is positioned within the shredder 10, the angle 52 is equal to the angle defined by the intersection between paper within the shredder 10 and a vertical plane intersecting the axis of rotation 44. In this manner, the flange 48 may more easily slide between sheets of paper when dispensing paper.

The outer perimeter of the stop plate 40 may have a radius 54*a* and the outer perimeter (relative to the axis of rotation 44) of the flange 48 may have a radius 54*b*. The difference between radius 54*a* and radius 54*b* may be selected to lift a desired number of sheets per revolution of the stop plate 40.

Figure 5:
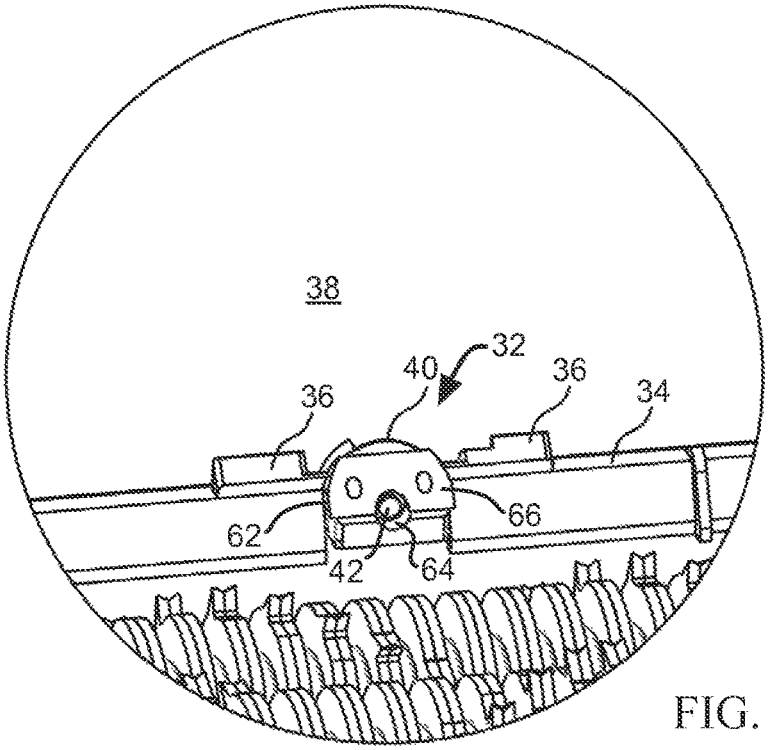
FIG. 5 is a partial isometric view of a metering assembly having a shaft support in accordance with an embodiment of the present invention.

Referring to FIG. 5, as noted above, the shaft 42 may be rotated by the motor 22. For example, the gear 30 engaging the gear assembly 26 may rotate a lateral shaft 58. The lateral shaft 58 may drive the shaft 42 by engagement of a bevel gear 60*a* secured to the shaft 58 with a bevel gear 60*b* secured to the shaft 42. As is apparent in FIG. 5, the rate of rotation of the shaft 42 and stop plate 40 relative to the rotation of the cutting blade assemblies 28 is determined by some or all of the gear assembly 24, gear assembly 26, gear 30, and bevel gears 60*a*, 60*b*. A desired relative rate of rotation of the shaft 42 and cutting blade assemblies 28 may also be achieved by other means, including electronic control of separate motors or some other means. In some embodiments, a controller may be operably coupled to the motor 22 and to a sensor 61 positioned adjacent the shaft 42 and operable to sense a rotational speed of the shaft 42, such as by means of optically detecting one or more optically detectable markings on the shaft 42, detecting variation in a magnetic field from a magnet attached to the shaft 42, mechanical actuation of a switch by the shaft 42 for each rotation, or any means known in the art for detecting rotational speed.

Referring to FIG. 5, in some embodiments a portion of the shaft 42 projects forwardly from the stop plate 40, e.g. away from the base 34. This portion may be engaged by a shaft support 62 defining an aperture 64 for receiving the portion of the shaft 42. The shaft support may be secured to the base 34 or to some other structure that is secured to the base 34, such as the housing 20 or paper tray 16 (See FIG. 1). In some embodiments, the shaft support 62 may be configured to facilitate movement of paper 38 past the shaft support 62. For example, the shaft support 62 may define an angled face 66 that slopes outwardly from the stop plate 40 with distance downward from the stop plate 40. The face 66 may define a plane that intersects the stop plate 40, such that paper sliding off the stop plate 40 will not catch on any horizontal or other surface of the shaft support 62. The face 66 may be defined by areas of the shaft support 62 surrounding the aperture 64.

Figure 6A:
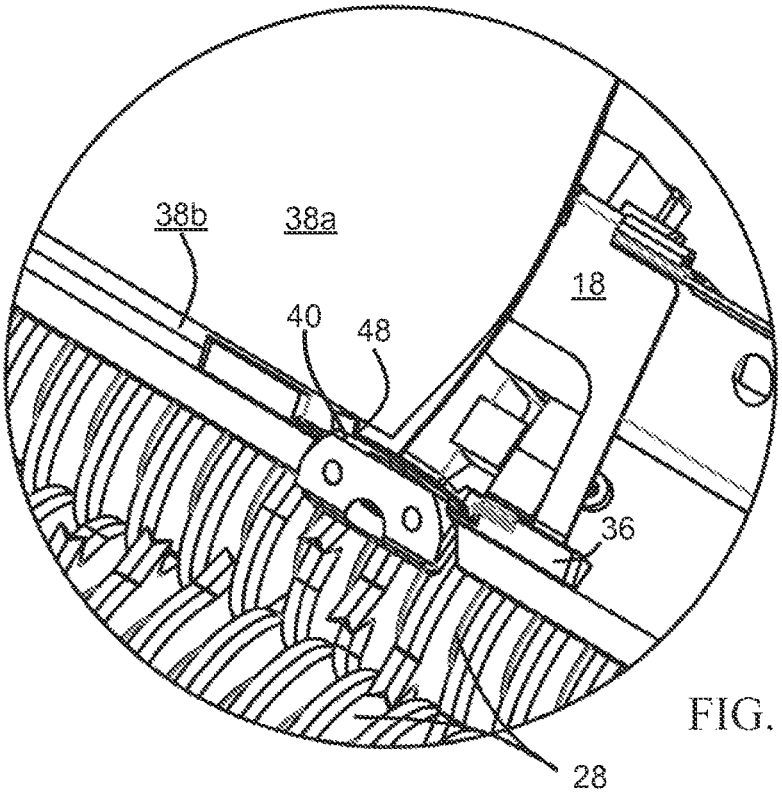
FIGS. 6A and 6B illustrate metered release of paper using a metering assembly in accordance with an embodiment of the present invention.
Figure 6B:
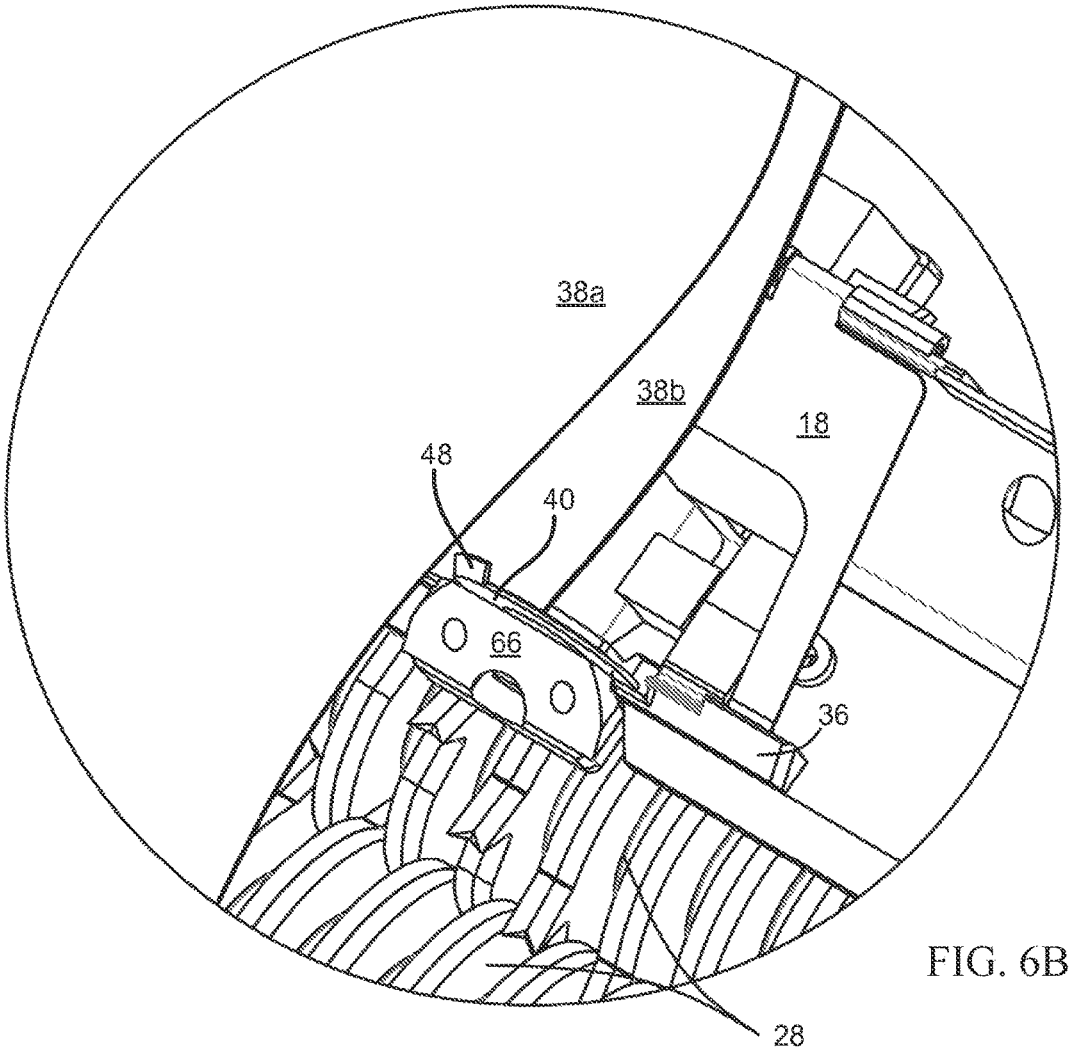

FIGS. 6A and 6B illustrate the manner of operation of the metering assembly 32. Referring specifically to FIG. 6A, as the stop plate 40 rotates, the flange 48 secured to the stop plate 40 engage the lower edge of a portion 38*a* of a load of paper thereby separating the portion 38*a* from the rest of the paper 38*b*. As the leading edge of the flange 48 rises to the apex of its rotation, shown in FIG. 7A, the paper 38*a* is lifted above any ridges 36. Referring specifically to FIG. 6B, as the stop plate 40 continues to rotate the portion 38*a* of the paper is allowed to fall past the stop plate 40 and any ridges 36 into the cutting blade assemblies 28. In particular, the portion 38*a* of paper may be allowed to fall at some point after the leading edge of the flange 48 begins to descend past the apex of its rotation. As noted above, the biasing plate 18 urges the remaining paper 38*b* against one or both of the ridges 36 and the stop plate 40 ready to be lifted by the flange 48 as the stop plate 40 continues to rotate.

As noted above, the stop plate 40 and cutting blade assemblies 28 may be constrained to rotate at a fixed relative rate of rotation. The rate of rotation of the cutting blade assemblies 28 may be effective to achieve a linear feed rate F (e.g. length per unit time) of paper through the cutting blade assemblies. The linear feed rate F may be the linear feed of the cutting blade assemblies when shredding a maximum number of sheets M. In some embodiments, M is the maximum permissible number of sheets that can be shredded simultaneously between the cutting blade assemblies 28 at one time without causing jamming of the cutting blade assemblies 28, failure of the motor 22, or other malfunction of the shredding assembly 14. The value M may be the value specified by the manufacturer of the shredding assembly as the maximum capacity, which may be some tolerance below the actual maximum simultaneous sheet limit for the shredding mechanism 14.

The stop plate 40 may rotate with a period T for the feed rate F such that a new portion 38*a* of paper drops into the cutting blade assemblies every period T. The period T may be such that for pages having a maximum length L multiple portions 38*a* of paper may be simultaneously present between the cutting blade assemblies. The number of portions 38*a* that will be simultaneously between the cutting blade assemblies may be equal to up to Ceiling(L/(F*T)). As noted above, the configuration of the flange 48 (See FIGS. 3A-3C) may determine the largest possible number (N) of sheets that may be lifted by the stop plate 40 per revolution. Accordingly, the largest possible number N of sheets and period T may be selected relative to the feed rate F such that N*Ceiling(L/(F*T)) is less than M.

While the preferred embodiments of the invention have been illustrated and described, as noted above, many changes can be made without departing from the spirit and scope of the invention. For example, although the feeder portion 12 is shown operating in combination with a shredding assembly 12, other sheets of material may be processed according by other material processing apparatus. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A shredder comprising:

a paper receptacle for receiving a load of paper;

a shredding assembly; and a metering assembly interposed between the paper receptacle and the shredding assembly, the metering assembly configured to separate a portion of the load of paper from the load of paper and permit the portion of the load of paper to move into the shredding assembly;

wherein the metering assembly comprises:

a metering shaft having an axis of rotation oriented perpendicular to lower edges of sheets in the load of paper;

a means for rotating the metering shaft; and a stop plate secured to the metering shaft and defining a lifting portion on a perimeter portion thereof, the lifting portion configured to engage a lower edge of the portion of the load of paper.

2. The shredder of claim 1, wherein the paper receptacle is at a higher elevation than the shredding assembly.

3. The shredder of claim 2, wherein the paper receptacle defines a ridge and the metering assembly is configured to urge the portion of the load of paper over the ridge.

4. The shredder of claim 3, wherein the paper receptacle further comprises:

a base positioned to support lower edges of sheets of the load of paper; and a support extending upwardly from a rear portion of the base, the ridge being secured to a forward portion of the base.

5. The shredder of claim 1, further comprising a biasing member positioned to urge the load of paper toward the metering assembly.

6. The shredder of claim 1, wherein stop plate is embodied as a wheel and wherein the lifting portion comprises a flange formed in a perimeter portion of the wheel.

7. The shredder of claim 6, wherein the flange comprises a section of a cone secured to the perimeter portion of the wheel and extending toward the paper receptacle.

8. The shredder of claim 1, further comprising a shaft support engaging the metering shaft having the stop plate positioned between the shaft support and the paper receptacle, the shaft support having a ramp secured thereto and defining a ramp surface sloping downwardly from the metering shaft.

9. The shredder of claim 1, wherein the lifting portion occupies a sector smaller than 60 degrees of the stop plate with respect to an axis of rotation of the metering shaft.

10. The shredder of claim 1, wherein the shredding assembly comprises:

two cutting blade assemblies; and a first motor coupled to the cutting shafts;

wherein the means for rotating the shaft is a second motor.

11. The shredder of claim 1, wherein the shredding assembly comprises:

two cutting blade assemblies;

a motor coupled to the cutting shafts; and a gear assembly coupling the motor to the two cutting blade assemblies and to the shaft.

12. The shredder of claim 11, wherein:

the gear assembly is configured to rotate the two cutting blade assemblies effective to achieve a linear feed rate (F) through the two cutting blade assemblies;

the lifting portion is configured such that the portion of the load of paper includes at most N sheets of paper;

the shredder has a sheet shredding maximum of M sheets;

the load of paper has a sheet length of L; and the gear assembly is further configured to rotate the metering shaft with a period (T) such that N*ceiling (L/(F*T)) is less than M.

13. A method for dispensing sheets of material, the method comprising:

providing a shredder comprising:

a paper receptacle for receiving a load of paper;

a shredding assembly;

a metering assembly interposed between the paper receptacle and the shredding assembly, the metering assembly configured to separate a portion of the load of paper from the load of paper and permit the portion of the load of paper to move into the shredding assembly, wherein the metering assembly comprises:

a metering shaft having an axis of rotation oriented perpendicular to lower edges of sheets in the load of paper;

a means for rotating the metering shaft; and a stop plate secured to the metering shaft and defining a lifting portion on a perimeter portion thereof, the lifting portion configured to engage a lower edge of the portion of the load of paper;

placing a load of sheets of material in the paper receptacle having the sheets of material oriented at an angle less than 45 degrees from vertical;

actuating the metering assembly to periodically urge portions of the load past the stop plate according to a metering period such that the portions of the load are allowed to fall past the stop plate, the metering assembly being positioned at a lower edge of the load of sheets of paper; and receiving the portions of the load in a material processing assembly positioned below the stop plate.

14. The method of claim 13, wherein:

a material processing assembly has a linear processing rate F and a maximum simultaneous sheet limit M; and the metering period (T), a maximum number of sheets of material (N) in each portion, and a maximum length (L) of the sheets of material, are such that N*ceiling(L/(F*T)) is less than M.

15. The method of claim 1, wherein actuating a metering assembly further comprises:

rotating the metering shaft.

* * * * *